US005241797A

United States Patent [19]

Cliff

[11] Patent Number: 5,241,797

[45] Date of Patent: Sep. 7, 1993

[54] ELEVATED WATER TANK FLOOR AND CONSTRUCTION THEREOF

[76] Inventor: John Cliff, 211 Deerfield La., Franklin, Tenn. 37064

[21] Appl. No.: 973,285

[22] Filed: Nov. 9, 1992

[51] Int. Cl.[5] ..... E04H 7/00

[52] U.S. Cl. ..... 52/192; 52/334; 52/745.01

[58] Field of Search ..... 52/334, 192, 329, 339, 52/319, 745.05–745.08, 745.01, 741.1

[56] References Cited

U.S. PATENT DOCUMENTS

| | | | |
|---|---|---|---|
| 4,259,822 | 4/1981 | McManus | 52/334 |
| 4,312,167 | 1/1982 | Cazaly et al. | 52/745.01 |
| 4,403,460 | 9/1983 | Hills | 52/745.01 |
| 4,454,695 | 6/1984 | Person | 52/334 |
| 4,486,989 | 12/1984 | Des Rochers et al. | 52/745.01 X |
| 4,578,921 | 4/1986 | Cazaly et al. | 52/745.01 |
| 4,660,336 | 4/1987 | Cazaly et al. | 52/192 |

*Primary Examiner*—Philip C. Kannan
*Attorney, Agent, or Firm*—Abe Hatcher

[57] ABSTRACT

A floor for a water tank on a tank support tower is made of a dome of steel bar-reinforced concrete over a lower steel base in a central portion encircling a center access tower, the dome being surrounded by and continuous with an annular rim also of concrete reinforced with steel bars but over a circular steel beam at the base of the dome. Studs are welded from the concrete area into the steel base and the steel beam. The floor is built by first centering the steel base between a bottom section of the tank support tower placed there to start and the center access tower and then constructing the tank support tower by the slipform or by the jumpform method while raising the steel floor base, lifting the circular steel beam and placing it on top of the tank support tower, installing the lower portion or cone of the elevated water tank above the tank support tower, securing the steel base of the dome in place on the circular steel beam and, after positioning the steel reinforcing bars where the concrete is to be poured and welding the studs into the steel base and the steel beam, pouring and curing the concrete thereover. The floor is bounded on the outside by the cone or lower portion of the tank.

9 Claims, 3 Drawing Sheets

ELEVATED WATER TANK FLOOR AND CONSTRUCTION THEREOF

FIELD OF THE INVENTION

1. Background of the Invention

This invention relates to elevated water tanks. More particularly, it relates to an elevated water tank floor and how to construct it.

2. Description of the Prior Art

Hills U.S. Pat. No. 4,403,460 deals with elevation of a completed tank by form work methods such as slipforming, including forming a bowl or inverted dome-shaped bottom and elevating it to installation level after the tank has been elevated. Czaly and Lamon U.S. Pat. No. 4,327,531 teaches alignment and then pouring a substantially level concrete tank floor after the tank has been suitably fabricated and hoisted. Both of these patents speak of using slipforming and jumpforming in construction. Hills explains in the aforementioned patent U.S. Pat. No. 4,403,460 that slipforming includes positioning a formwork, pouring concrete into the formwork, and then, repeating the procedure until the desired height is obtained. Slipforming apparatus uses a self-climbing framework, with reinforcing steel placed as the frame moves upwardly. Jumpforming is basically the same except for moving the form upwardly intermittently and pouring some concrete in one step and some in another.

Despite the improvements made in the elevated water tank industry by the aforesaid U.S. Pat. Nos. 4,403,460 of Hills and 4,327,531 of Czaly and Lamon, however, the support structures, particularly the tank floors, can stand improvement when it comes to compressive forces encountered, particularly when the inward forces of the cone of the tank exceed the outward forces of the elevated water tank when filled with water, without leakage.

SUMMARY OF THE INVENTION

After extended investigation I have solved these compressive forces and leakage problems by providing an elevated water tank floor made of a steel base with reinforced concrete thereover, the concrete being joined to the steel base by studs. My floor is characterized by being dome-shaped in a center circular portion which is surrounded by an annular portion which reaches on the outside to a lower conical portion of the elevated water tank of the elevated water tower, the elevated water tower referring to the whole structure of an elevated water tank mounted on a tank support tower with a center access tower, the floor of the invention stretching to the center access tower on the inside. The surrounding annular rim or ring or portion serves as a support beam for the tank. When I say that my floor is dome-shaped in the center, I mean that the dome circle upward instead of downward like a bowl and looks like the dome of a capitol.

I have found that I can construct such an elevated water tank floor by placing the dome-shaped steel base around a center access tower already in place inside a first section of the tank support tower, that is, centered between the tank support tower and a center access tower, at ground level, continuing to construct remaining sections of the tank support tower, either by slipforming or by jumpforming while raising the steel water tank floor base and then placing it on a circular or circumferential or annular steel beam, which I lift up and place on the top section of the tank support tower. The concrete is poured around steel reinforcing bars such as REBARS, and studs are welded to the steel floor base, the concrete being poured and cured in place on the circumferential or circular or annular steel beam and the steel base continuous therewith to form the elevated water tank floor of the invention.

The annular rim or ring portion of the water tank floor of the invention is continuous with the dome or dome-shaped portion. The concrete is poured onto the dome-shaped steel base and surrounding annular steel rim or ring, being reinforced with steel bars, for example REBARS, as mentioned hereinabove, with studs welded into the steel base and the steel beam from the concrete.

I elevate the tank floor steel base from ground level to the desired tank bottom level, that is, the level of the top of the tank support tower, while building the tank support tower, which may be steel or concrete, by slipforming or jumpforming. The steel floor base is put together in sections, preferably pie-shaped, as it is raised after the cone or conical or funnel-shaped portion of the tank and the foregoing annular or circumferential steel beam which serves as a compressive ring and which I employ according to my invention for supporting the tank floor have been lifted into position atop the slipformed or jumpformed tank support tower. This procedure is followed to enable use of the steel floor base as a platform during slip or jumpforming and to keep the inside of the circular tank support tower substantially equidistant from the circular outside of the dome-shaped tank floor steel base. Prior to lifting the steel base of the tank floor upward I prefer to employ a series of pipes added between the center access cylinder (also referred to hereas the center access tower) and the tank support tower. These also help to maintain the floor roundness and prevent the center access cylinder from rotating when a crane such as a Kingpost crane is used to erect the tank support tower, At the juncture of the pipes with the steel floor base a cam lock device may be added for contact between the pipe ends and the tank support tower. The cam lock acts as a stabilizer when at a level of construction and also as a safety device to prevent the tank floor from falling should the supports fail. This cam lock device may be operated hydraulically manually or otherwise mechanically so as to be rotated, contracted or retracted from the tank support tower. This stabilizer and safety device may also include hydraulically actuated rams or the like.

After the water tank steel base portion of the floor has been placed on the circumferential or annular steel ring or rim atop the tank support tower, the cone-shaped portion, concrete lower portion of the tank is then installed in sections. The concrete is then poured onto the steel base formed by the dome-shaped portion of the floor and on the annular steel rim or ring continuous therewith. A derrick may be used, preferably a Kingpost crane, for lifting, for example as mentioned hereinabove in connection with the erection of the tank support tower, as may hydraulic jacks, chain falls, cable winches, either manual or powered, for lifting the working platform or steel base of the water tank floor.

The steel base dome-shaped portion of the elevated water tank floor may be used as a working platform proceeding up the inside of the center access cylinder and as a scaffold crane platform or slipform support to maintain cylinder roundness and worker safety and efficiency. The steel base rises in increments as each segment is added to the tank support tower, or continuously in the case of slipforming, as detailed hereinabove. The preferred method of raising the water tower steel floor base is by climbing the tower wall, either by utilizing slipform jacks or lifting in segments from supports attached to sidewalls or stiffeners of the center access cylinder, as will be explained in more detail in connection with the description of the drawing hereinbelow.

A suspended platform is used to bridge from the tower to the center access cylinder. This also helps to support a crane. The suspended platform is attached together with a rotator therefor at ground level. This may become a permanent part of the elevated water tank tower as does the steel base upon which the concrete is poured to form the water tank floor.

Among the advantages of my invention which may readily be seen from the preceding description is the multiuse of the floor structure involved. More specifically, the water tank steel floor base is initially built on the ground prior to its use in supporting a derrick and scaffold and the raising mechanisms such as the slipform, jacks, winches and the like. When put securely in place at the top of the tank support tower, it becomes the support for the rest of the floor, the poured concrete with reinforcing bars, sheer connectors such as studs welded to it, and the center access cylinder, as well as a welded water-tight seal to prevent leakage when the tank is filled with water.

BRIEF DESCRIPTION OF THE DRAWING

For a better understanding of my invention reference will now be made to the drawing which forms a part hereof.

In the drawing.

DETAILED DESCRIPTION

Figure 1:
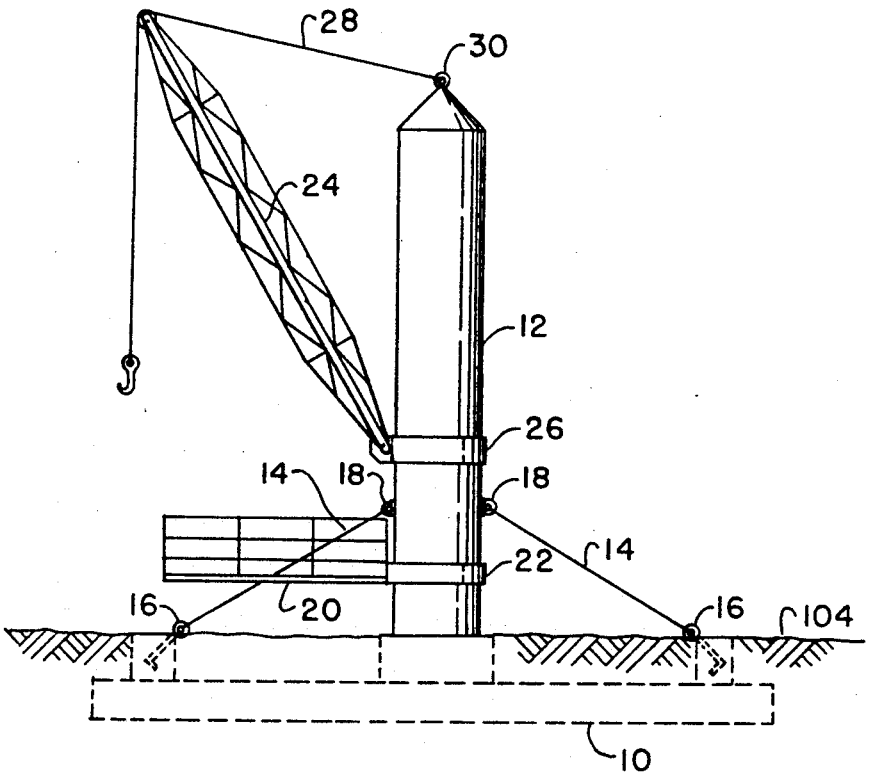
FIG. 1 is an elevation view showing a first stage of construction a water tank floor according to the invention.
Figure 2:
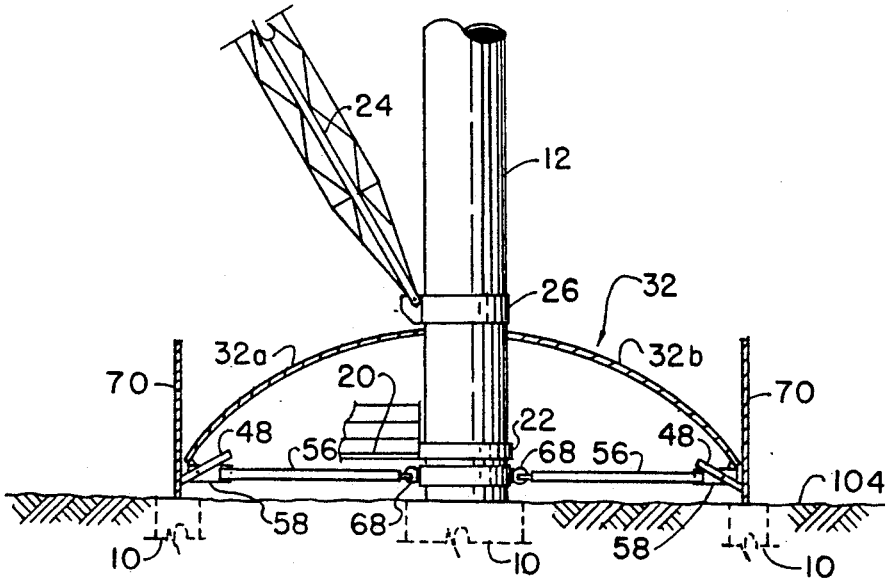
FIG. 2 is a sectional view of a second stage of a jump form of construction of a water tank according to the invention.

In the drawing, center access cylinder is shown in FIG. 1 in a first phase of constructing the water tower floor of the invention as in position for starting construction as erected on and supported by an underground foundation 10 and anchored by guy cables via bolts 16, the guy cables 14 running from eye bolt-like attachment mechanism 18 on center access tower 12 to the bolts 16 at ground level 104. A rotating crane 24 having an adjustable anchor cable 28 with means for providing it with an anchor point 30 is attached to cylinder 12 via annular ring-like attachment means 26. A rotating work platform 20 is similarly attached by annular attachment mechanism 22. In the second phase of construction, as seen in FIG. 2,, the guy cables 14 have been removed and a steel dome-shaped floor base 32 has been positioned as sections **32*a*, 32*b* inside a first increment or section of a tank support tower 34, 70, as have thrust pipes 56 (shown also in FIGS. 3, 4, 5 and 6), which run between wing plates 58 at lock shoe 48 and central slip ring connections 68 to slip rings 66 (FIG. 3) at center access cylinder 12. Lock shoes 48 with associated bolts 50 and washers 52 and having a knurled end 54 prevent floor base 32 from slipping or falling downward. In FIG. 4 plate 60 and angle 60*a* are shown as being for floor 32*a*-to-slipform 36 connection. Connection 94 joins floor base 32*a* to wingplate 58. Shown more specifically, particularly in relation to slipform 36, in FIG. 4, for connection purposes, are plates 60 for connecting tank floor base 32 to slipform 36, angles 60*a* also used in connecting base 32 to slipform 36 and bolts 62 and nuts 64 or use in the same floor-to-slipform connection. Also shown in FIG. 4 is floor to wingplate connection 94**.

Figure 3:
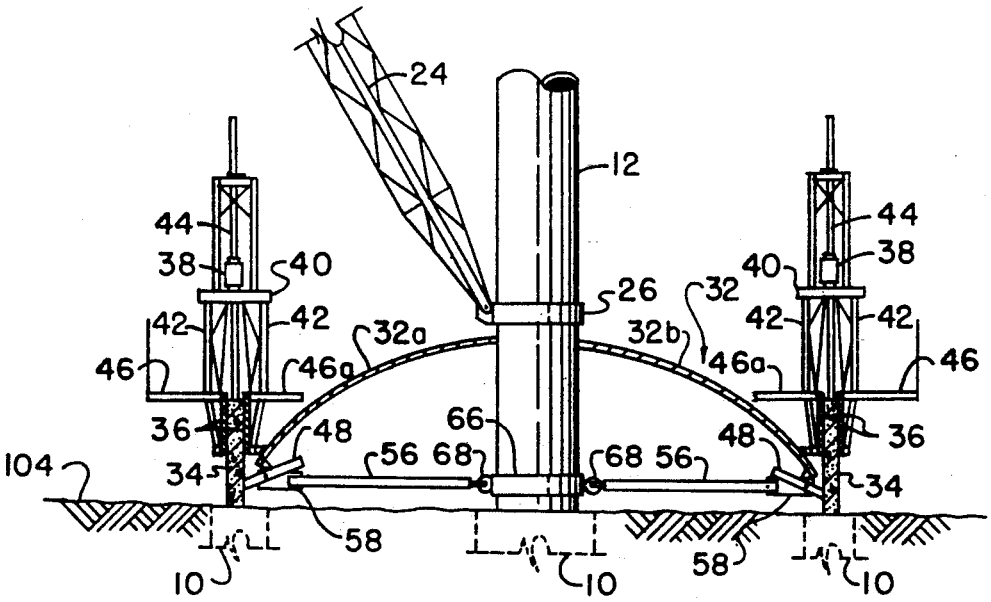
FIG. 3 is an elevation sectional view of a ground stage of a slipform method of building the tower while the floor base is being lifted.
Figure 4:
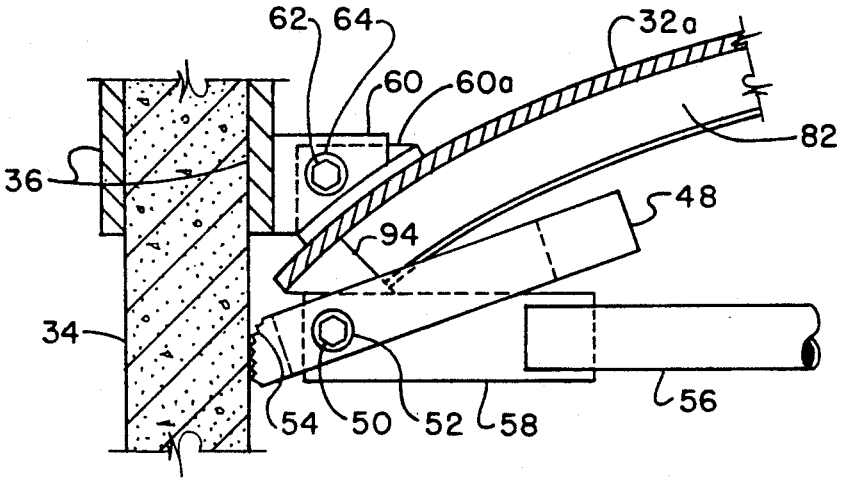
FIG. 4 is an elevation detail, partly in cross section, of a safety or construction stop, which may also be referred to as a lock shoe, showing its relationship to the tank floor of the invention.
Figure 5:
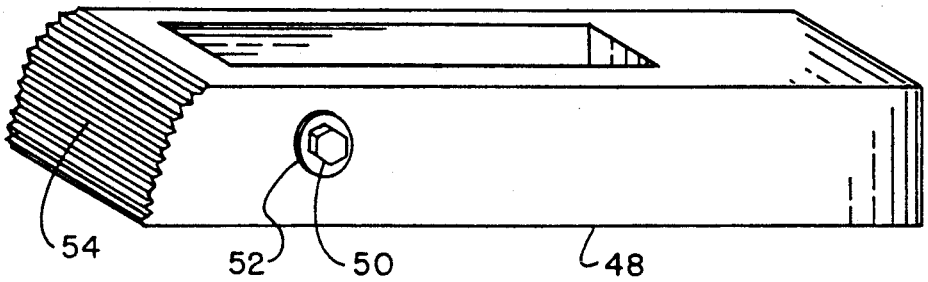
FIG. 5 is a perspective view of the safety or construction stop shown in FIG. 4.

In FIG. 3 is depicted a slipform 36 used in slipforming tank support tower 34 while moving steel tank base upward toward its place at the bottom of tank 122 (See also FIGS. 7 and 8) for use along with annular steel rim or ring 75 as floor support and substrate for concrete to be poured upon, by means of an hydraulic jack 38 mechanism which includes yoke beam 40, yoke leg 42, jack rod 44 and respective outer and inner platforms 46 and **46*a* as tank support tower 34** has concrete continuously added thereto.

Figure 7:
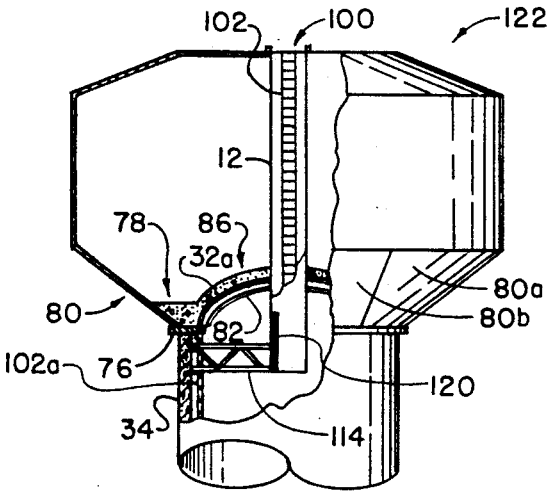
FIG. 7 is a perspective view, partly cut away and sectional, of a completed tank support tower and center access cylinder, including a tank floor according to the invention.
Figure 8:
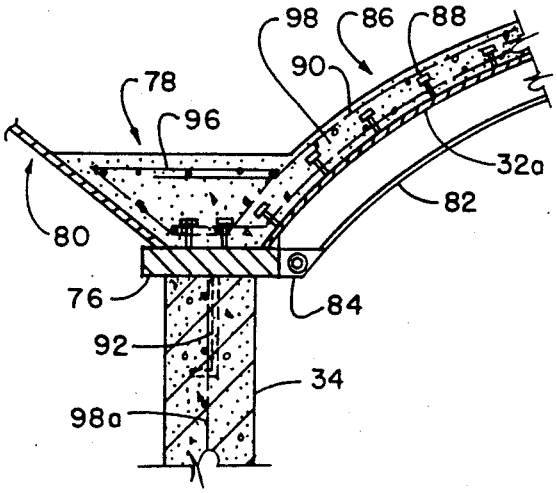
FIG. 8 is a sectional detail view, broken away in part, showing a representative portion of an elevated water tank floor of the invention.

Looking additionally now at FIGS. 7 and 8 particularly, after putting steel tank floor base sections **32*a*, 32*b* and other sections together to form the completed floor base 32 at a water tank floor height at the top of a completed tank support tower 34 adjoining annular steel rim or ring 76, reinforcing steel bars 90, 96 are put in place, concrete is poured on base 32 and annular or circumferential rim or ring, limited on the circular periphery by a lower conical or funnel-shaped portion 80 (as opposed to the upper portion 122) of the elevated water tank and on the inside by the center access cylinder or tower 12, and the studs are welded into the underlying steel 32, 76 all to form the elevated water tank of the invention 78 (annular portion), 86 (dome-shaped portion). Angle 82 fastened to annular steel rim 76 by bolts 84 provides additional support for floor 78, 86. Anchor bolts 92 are welded to transition beam or annular rim or ring 76 from tank support tower 34 . The concrete of the tank support tower 34 of FIG. 8 is also reinforced by steel bars 98*a*. Seen on the upper portion of the tank 122 is a ladder 102. Tank support tower 34 also has one 102*a*. The conical portion 80 of the tank may also be put up in sections 80*a*, 80*b*** or the like and must be lifted to position prior to pouring the floor concrete as it is the outer limit of the floor.

Figure 6:
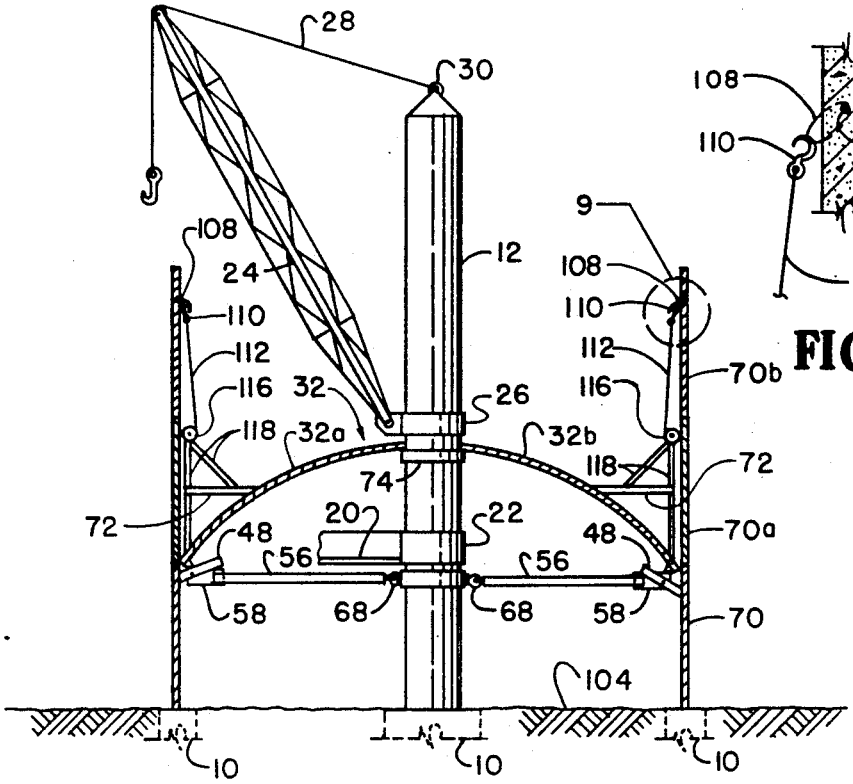
FIG. 6 is a perspective view, partly in cross section, of an increment of the construction step begun in FIG. 2.
Figure 9:
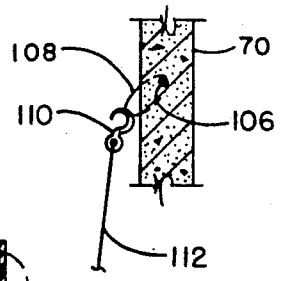
FIG. 9 is a blowup of a portion of FIG. 6 (circled) showing a hook and loop jumpformelevating mechanism for building segments of a tank support tower as the steel base for the dome portion of the water tank floor is raised to its installation position.

Further with respect to FIGS. 6 and 7 and to the enlargement of the hook-line arrangement of FIG. 6 shown in more detail in FIG. 9, an elevated water tower is shown as having an access hatch 100, two ladders 102 and 102*a* already referred to, an access opening 120 to center access cylinder 12 and a catwalk 114 to center access cylinder 12. The lifting mechanism for jumpforming the tank support tower 34 here includes a loop 108, a steel cable 112, a hook 110, a hand crab 116 and a support 118 for the hand crab 116. Center access cylinder 12 has an access opening 120. In this jumpforming method for constructing the tank support tower 70 in increments or jumps 70, 70*a* and 70*b*, the tank support tower 70 may be either of steel or concrete, in the latter case, the concrete being poured in increments or steps.

In conjunction with the lower conical portion or cone of the tank, steel bar or beam 76, which provides the form for thrust block or annular beam 78, which includes reinforcing steel bars 96, sheer anchors or studs 88 and concrete 98, this thrust block or annular rim portion 76 of the tank floor 78, 86 neutralizes any inward or outward imbalance forces created by the water load on the tank on the outer tank cone or lower portion of the tank 80 or the inner tank floor 86.

Central dome portion 86 and outer annular portion 78 of the water tank floor of the invention are shown in detail in FIGS. 7 and 8, including the concrete 98 of both portions, studs 88 welded to annular steel rim or beam 76 atop concrete 98*a* of the tank support tower 34. Additional support is given to the water tank floor 78, 86 by steel angle 82, which has a connection 84 to annular or circumferential rim or ring or beam 76.

While the invention has been described in terms of preferred embodiments, the claims appended hereto are intended to encompass all embodiments which fall within the spirit of the invention.

Having thus described my invention and certain preferred embodiments thereof, I claim:

1. In an elevated water tower comprising a water tank having a lower conical portion supported above a tank support tower, said tank support tower having a center access cylinder, an elevated water tank floor comprising from a top surface to a bottom surface respective layers of cured concrete and a steel base, said water tank floor having two continuous portions comprising a centrally positioned dome-shaped portion surrounding said center access cylinder in a circular manner and a substantially flat annular portion encircling said dome-shaped portion at a base thereof and continuous therewith, said respective layers having reinforcing bars in said concrete and sheer connectors joined to said steel base, said annular portion of said water tank floor being bounded on the outside by said lower conical portion of said water tank.

2. The water tank floor of claim 1 wherein the steel base of said annular portion forms an annular compressive steel beam.

3. The water tank floor of claim 1 having additionally in association therewith-a camlock stabilizer running between the center access tower and the tank support tower.

4. The water tank floor of claim 1 having additionally in association therewith a workers' platform attached to the center access cylinder.

5. A process for construction of an elevated water tank floor which comprises putting in place at ground level a center access tower and a first section of a surrounding tank support tower, building in sections a dome-shaped steel floor base equally spaced between said center access tower and said tank support tower, adding increments to a first section of said tank support tower to a height for a tank while raising said dome-shaped steel floor base to substantially the same height, lifting an annular steel beam and placing it on a top section of the resulting tank support tower, resting the steel floor base on said annular steel beam, constructing a lower conical portion of said tank on said annular steel beam, placing reinforcing steel bars in place where concrete is to be poured onto the steel floor base and the annular steel beam, joining sheer connections to the steel floor base and curing the concrete in place to form the elevated water tank floor.

6. The process of claim 5 wherein the construction of the tank support tower in increments is by slipforming.

7. The process of claim 5 wherein the construction of the tank support tower in increments is by jumpforming.

8. The process of claim 5 wherein the steel base is used as a working platform and cables, jacks, winches and a derrick are used for lifting the steel base.

9. An elevated water tank floor comprising a dome-shaped steel base having a layer of concrete thereover reinforced with steel bars, said dome-shaped steel base surrounding an axial center access tower and having therearound at the foot of said dome over an annular steel beam continued from said steel base an annular rim of concrete, said annular rim of concrete connecting said steel base having a layer of concrete thereover reinforced with steel bars to a lower conical portion of the elevated water tank, the concrete being joined to the steel base by sheet connectors.

* * * * *